US008562269B2

(12) United States Patent
Hermes et al.

(10) Patent No.: US 8,562,269 B2
(45) Date of Patent: Oct. 22, 2013

(54) DRILLING APPARATUS

(75) Inventors: Stefan Hermes, Lennestadt (DE); Raimund Grobbel, Eslohe (DE)

(73) Assignee: Tracto-Technik GmbH & Co. KG, Lennestadt (DE)

( * ) Notice: Subject to any disclaimer, the term of this patent is extended or adjusted under 35 U.S.C. 154(b) by 403 days.

(21) Appl. No.: 12/846,248

(22) Filed: Jul. 29, 2010

(65) Prior Publication Data

US 2011/0200413 A1 Aug. 18, 2011

(30) Foreign Application Priority Data

Jul. 29, 2009 (DE) ..... 10 2009 035 277

(51) Int. Cl.
*E21B 19/00* (2006.01)

(52) U.S. Cl.
USPC ..... 414/22.62; 414/751.1

(58) Field of Classification Search
USPC ..... 166/77.51; 175/85; 212/224, 319; 294/116, 119.1, 198, 207, 34, 67.33, 294/87.22, 94, 97; 414/22.51–22.59, 22.61, 414/22.62, 226.02, 23, 621, 626, 732, 741, 414/745.7, 745.8, 745.9, 746.1, 746.3, 414/746.4, 753.1, 909, 910, 22.54, 561, 414/735, 745.1, 745.3, 745.4, 745.5, 745.6, 414/749.4, 751.1
See application file for complete search history.

(56) References Cited

U.S. PATENT DOCUMENTS

| | | | | | |
|---|---|---|---|---|---|
| 2,911,251 | A | * | 11/1959 | Osborn | 294/110.1 |
| 3,088,505 | A | * | 5/1963 | Pearson | 144/215.2 |
| 3,145,786 | A | * | 8/1964 | O'Neill et al. | 175/85 |
| 3,170,322 | A | * | 2/1965 | Cavanaugh | 73/857 |
| 3,918,536 | A | | 11/1975 | Deeter et al. | |
| 4,553,719 | A | * | 11/1985 | Ott | 244/118.1 |
| 4,571,149 | A | * | 2/1986 | Soroka et al. | 414/749.1 |
| 4,604,724 | A | * | 8/1986 | Shaginian et al. | 700/213 |
| 4,647,097 | A | * | 3/1987 | Lessway | 294/195 |
| 4,650,235 | A | | 3/1987 | Shaginian et al. | |
| 4,834,604 | A | * | 5/1989 | Brittain et al. | 414/22.55 |
| 4,998,860 | A | * | 3/1991 | Dehne | 198/750.1 |
| 5,183,122 | A | * | 2/1993 | Rowbotham et al. | 175/52 |
| 5,941,324 | A | | 8/1999 | Bennett | |
| 6,099,227 | A | * | 8/2000 | Shellhammer | 414/24.5 |
| 6,315,513 | B1 | * | 11/2001 | Harukawa et al. | 414/286 |
| 6,926,488 | B1 | * | 8/2005 | Bolding et al. | 414/22.62 |
| 6,969,222 | B1 | | 11/2005 | Koch | |
| 7,047,785 | B2 | * | 5/2006 | Peruzzo et al. | 72/306 |
| 7,140,453 | B2 | * | 11/2006 | Ayling | 175/52 |
| 2004/0022605 | A1 | | 2/2004 | Anthis et al. | |

FOREIGN PATENT DOCUMENTS

| | | | |
|---|---|---|---|
| DE | 299 03 909 | | 11/1999 |
| DE | 199 53 458 | C1 | 7/2001 |
| DE | 10206645 | A1 * | 8/2003 |
| EP | 705378 | | 10/1996 |
| WO | WO 9855728 | A1 * | 12/1998 |
| WO | WO 2005/073497 | | 8/2005 |

* cited by examiner

*Primary Examiner* — Gregory Adams
(74) *Attorney, Agent, or Firm* — Henry M Feiereisen LLC

(57) ABSTRACT

A drilling apparatus includes a drill rig which defines a drilling rod axis, a rod magazine for a plurality of rod sections, and a transfer device for transfer of a rod section from the rod magazine and for transfer of the rod section in the drilling rod axis. The transfer device is hereby constructed to travel in the direction of the longitudinal axis of the rod section in relation to the rod magazine.

8 Claims, 3 Drawing Sheets

DRILLING APPARATUS

CROSS-REFERENCES TO RELATED APPLICATIONS

This application claims the priority of German Patent Application, Serial No. 10 2009 035 277.5, filed Jul. 29, 2009, pursuant to 35 U.S.C. 119(a)-(d), the content of which is incorporated herein by reference in its entirety as if fully set forth herein.

BACKGROUND OF THE INVENTION

The present invention relates in general to a drilling apparatus for underground works.

The following discussion of related art is provided to assist the reader in understanding the advantages of the invention, and is not to be construed as an admission that this related art is prior art to this invention.

When introducing boreholes in the ground and in particular when horizontal drilling is involved in which a borehole, starting from the surface or a starting shaft provided in the ground, is made horizontally or slantingly into the soil, drilling rod assemblies are typically used comprised of individual rod sections which are successively connected with one another in accordance with the progress of the drilling operation. In this way, relatively short rod sections enable the introduction of boreholes which extend sometimes several hundred meters.

Attachment of a new rod section to the drilling rod is carried out automatically in many drilling apparatuses. The drilling apparatuses include for that purpose typically a rod magazine to store a plurality of rod sections, as well as a rod transfer device which grabs a rod section liberated from the rod magazine to position it in the drill rig of the drilling apparatus in such a way as to arrange the longitudinal axis of the respective rod section in coaxial relationship to the longitudinal axis of the drilling rod. The thus positioned rod section can be gripped by means of a rotary drive and moved towards the free end of the rod section and then screwed with the rear end of the drilling rod through rotation of the rod section.

U.S. Pat. No. 6,969,222 discloses a drilling apparatus in which a rod magazine is positioned above and laterally of the drilling rod axis and the individual rod sections are transported from the transfer position below the rod magazine by means of a pivot arm into the drilling rod axis. This prior art has the drawback that a movement of the rod section to be newly attached towards the rear end of the drilling rod requires a shift of the rod section in the mounting of the rod transfer device, causing high wear of the rod section as well as of the transfer device, in particular when clamping the rod section in the rod transfer device is involved.

It would therefore be desirable and advantageous to provide an improved drilling apparatus to obviate prior art shortcomings and to significantly reduce wear of a rod section and the mounting of a transfer device, when transferring the rod section in the drilling rod axis.

SUMMARY OF THE INVENTION

According to one aspect of the present invention, a drilling apparatus includes a drill rig which defines a drilling rod axis, a rod magazine storing a plurality of rod sections, and a transfer device for transfer of a rod section from the rod magazine and for transfer of the rod section in the drilling rod axis of the drill rig, with the transfer device being movable in a direction of a longitudinal axis of the rod section in relation to the rod magazine.

As a result of a drilling apparatus according to the present invention, wear of the rod section and the transfer device is reduced as there is no relative movement between the rod section and the transfer device when the rod section moves in direction of its longitudinal axis, in order to move the rod section to the free end of the rod string. Rather, the transfer device is moved jointly with the rod section fixed therein in relation to the rod magazine.

To ensure clarity, it is necessary to establish the definition of several important terms and expressions that will be used throughout this disclosure. The term "drill rig" relates to a device by means of which a drilling rod comprised of several rod sections can be driven into the ground. It includes normally at least one linear drive for driving the drilling rod, a rotary drive for rotatingly driving the drilling rod, and one or more clamping devices by which the drilling rod and the rod section being attached can be fixed. A clamping device is normally provided in order to be able to secure the free end of the drilling rod so as to allow a threaded engagement of a rod section being newly attached.

The term "drilling rod axis" relates to the axis which is formed by the longitudinal axes of the individual rod sections of the drilling rod.

According to another advantageous feature of the present invention, the mobility of the transfer device in relation to the rod magazine can be implemented by a fluid cylinder. Fluid cylinders can be used especially advantageous when there is no need for great travel paths. In this case, a fluid cylinder can be integrated in a simple and especially space-saving manner in the transfer device because the approach of the rod section being attached to the rear end of the drilling rod normally does not require great travel paths. Furthermore, the operation of the fluid cylinder allows advantageously the use of a fluid supply (e.g. compressed air supply; hydraulic circulation) which normally exists in drilling apparatuses.

According to another advantageous feature of the present invention, the fluid cylinder can be arranged within a tube of the transfer device, with the tube being supported in a guide for movement in direction of the longitudinal axis and with either the piston or the cylinder of the fluid cylinder being connected with the guide, and the cylinder or the piston being connected with the tube. This configuration enables a complete and especially space-saving integration of the fluid cylinder in the transfer device of the drilling apparatus according to the invention.

According to another advantageous feature of the present invention, the gripping unit of the transfer device may include two grippers in spaced-apart disposition on the tube for gripping a rod section in the rod magazine. By providing at least two grippers, a rod section whose length is normally a multiple of the diameter, can be reliably grabbed. Suitably, each of the grippers is able to grab the rod section in the area of the ends of the rod section. Of course, gripping is also possible by using only one gripper which advantageously should grab in midsection of the rod section. When the rod sections are very long, as is oftentimes the case in drilling apparatuses, the use of only one gripper may however cause a sagging of the ends of the rod section, rendering a precise positioning of the ends of the rod section in the drilling rod axis difficult. Providing more than two grippers (e.g. three or four) is normally not necessary, but may be appropriate, when very long rod sections are involved in order to prevent a sagging of the rod section in the middle.

According to another advantageous feature of the present invention, the grippers may be arranged on opposite ends of the tube which has integrated therein the fluid cylinder. As a result, the tube, serving as housing for the fluid cylinder, serves at the same time as a restraining device for the two grippers.

According to another advantageous feature of the present invention, each of the grippers may include at least two gripping elements which are swingable about a pivot axis and capable of being acted upon by a wedge in the direction of their closed position. Displacing the wedge in order to act upon the gripping elements may hereby be realized preferably by means of a fluid cylinder. By having a wedge act upon the gripping elements, sufficiently great gripping forces can be exerted upon the rod section in a structurally simple manner.

According to another advantageous feature of the present invention, the transfer device may include a spring to bias the gripping elements as to seek their open position. In this way, the grippers can be completely released from the rod section, when the wedges of the grippers retract.

According to another advantageous feature of the present invention, the transfer device may include further drives to move the gripping unit in a direction of two further axes in relation to the rod magazine in addition to the movement in the longitudinal direction of the rod section. Suitably, the axes may extend perpendicular to one another. In this way, it is possible, to arrange the rod magazine fixed in relation to the drill rig and for example to the side and above the drill rig, and to realize the required height and lateral movements of the rod section in order to be brought from a transfer position of the rod magazine into the coaxial position with the drilling rod axis solely by a movement of the transfer device. In particular the need for a movement of the rod magazine, loaded with a plurality of rod sections and thus possibly heavy rod magazine, can thereby be eliminated.

A movement of the transfer device along the two further axes may be realized advantageously by means of two rack-and-pinion drives because in this way even greater travel paths can be realized in a constructively simple manner. In addition, rack-and-pinion drives are characterized by a high stability and reliable operation. Of course, any other drives may be used, especially linear drives, for moving the transfer device. For example, hydraulically or pneumatically driven cylinders or also spindles driven by a motor (e.g. electric motor, hydraulic motor, etc.) can be used.

Each of the rack-and-pinion drives may advantageously include a fluid motor so that again the fluid supply typically present in drilling apparatuses can be used.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
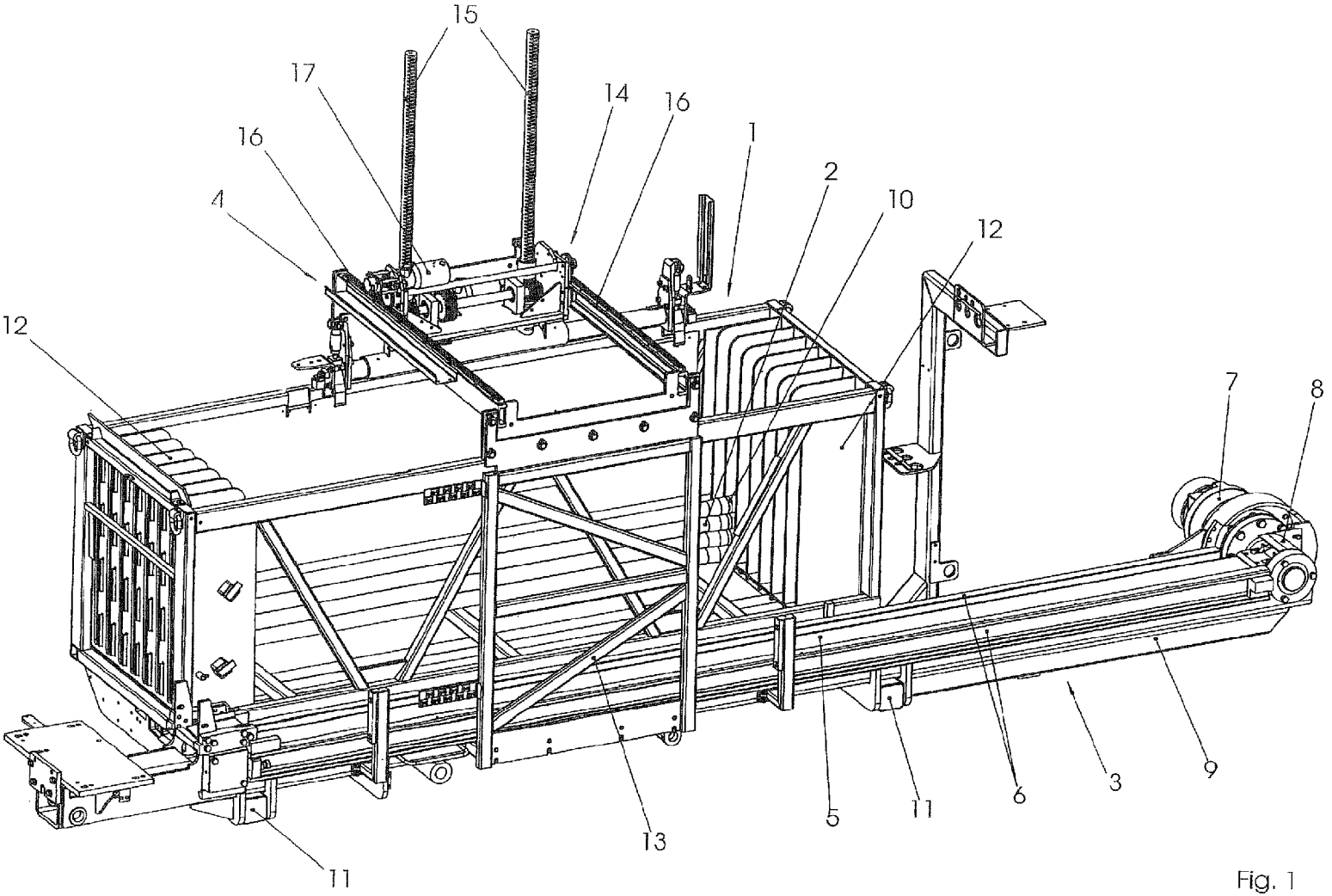
FIG. 1 is an isometric illustration of a drilling apparatus according to the present invention in a first operative position.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown an isometric illustration of a drilling apparatus according to the present invention in a first operative position. The drilling apparatus includes as essential assemblies a rod magazine 1 with a plurality of stored rod sections 2, a drill rig 3 of which only a part is shown, as well as a transfer device 4 by which the rod sections 2 can be removed from the rod magazine and positioned in the drill rig 3.

The illustrated part of the drill rig 3 includes a base carrier 5 above which the individual rod sections 2, which are provided for a connection with the free end of the already bored drilling rod (not shown), are positioned. Two rails 6 are provided on the base carrier 5 of the drill rig 3 for movably supporting a drive carriage (not shown). The drive carriage is connected on the back with a driving chain (not shown) which is driven by a hydraulic motor 7 arranged at an end of the base carrier 5. The part of the driving chain projecting in dependence on the position of the drive carriage on the base carrier 5 is deflected by about 180° by a first guide 8 at the end of the base carrier 5 and guided on the underside of the base carrier in a provided second guide 9.

Provided on the drive carriage is a rotary drive (not shown) which, on one hand, serves to rotatably drive the drilling rod during advance and, on the other hand, is provided for a threaded engagement of the rod section 2 to be newly attached with the free end of the already bored drilling rod. For that purpose, the rotary drive which has a driveshaft with an outer thread at the front side is screwed into the threaded bushing 10 arranged at the rear of the rod section 2, and then the forward end of the rod section 2, which has a respective threaded pin, is moved towards the free end of the drilling rod and screwed into the threaded bushing 10 of the last rod section 2 of the drilling rod. To prevent an inadvertent turning of the drilling rod, provision is made for a clamping unit (not shown) at the drill rig 3 on the forward (i.e. in the drawing to the left) end of the base carrier 5 for securing the end of the last rod section 2 of the drilling rod so as to avoid a rotation of the drilling rod during threaded engagement of the new rod section 2.

An example of a construction and manner in which a drill rig can be operatively and functionally incorporated into the drilling apparatus of the present invention is fully described in DE 199 53 458 C1, the entire specification and drawings of which are expressly incorporated herein by reference.

Positioned next to the base carrier 5 of the drill rig 3 is the rod magazine 1. The base carrier 5 of the drill rig 3 and also the rod magazine 1 are secured on the same crossbeams 11 and therefore immobile relative to one another. The rod magazine 1 has the shape of a block and is composed of a plurality of frame sections interconnected with one another. The topside of the rod magazine 1 is open so that the transfer device 4 is able to engage into the rod magazine 1 and withdraw a rod section 2. Seven partition walls 12 are provided within the rod magazine 1 on each of the forward and rearward narrow sides for subdividing the interior space of the rod magazine 1 into eight separate compartments. Each of these separate compartments may support a plurality of stacked rod sections 2.

Figure 3:
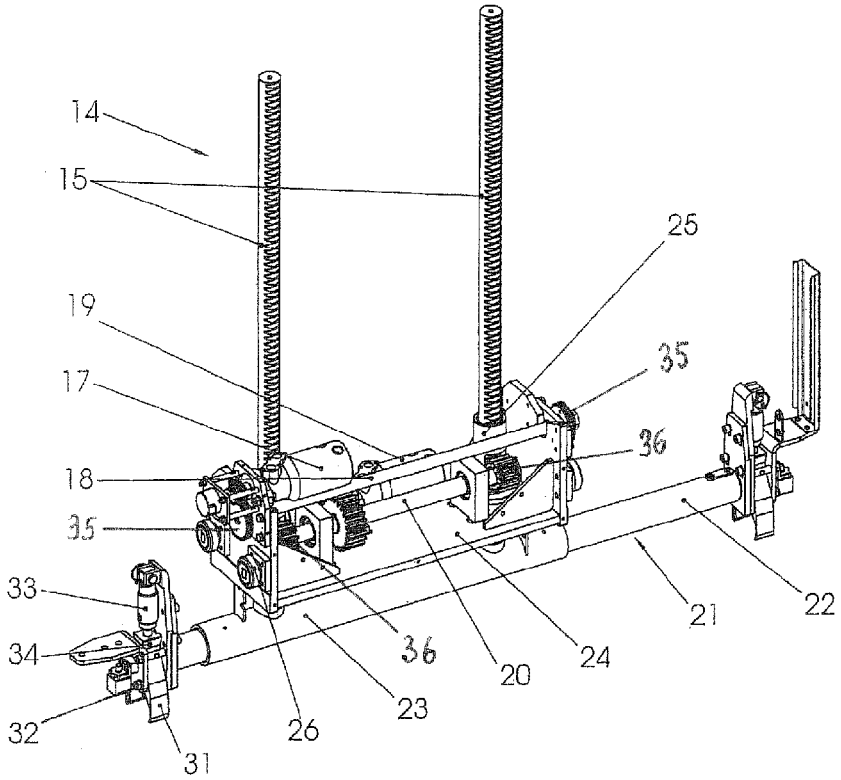
FIG. 3 is an enlarged detailed view of a part of the transfer device of the drilling apparatus according to FIGS. 1 and 2.
Figure 4:
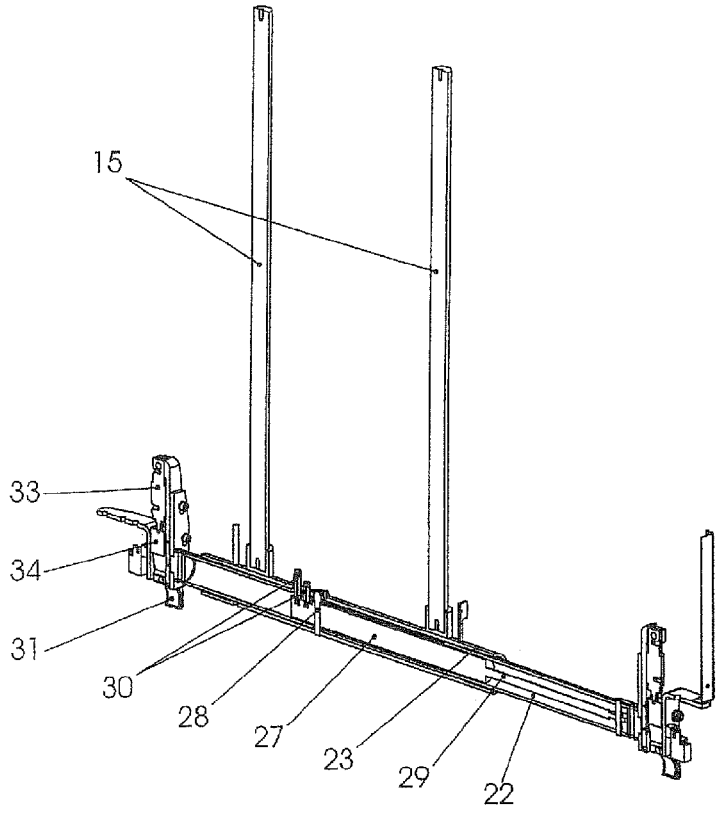
FIG. 4 is a longitudinal section of the part of the transfer device according to FIG. 3.

The transfer device 4 is situated above the rod magazine 1 and connected via a carrier frame 13 with an outer wall of the rod magazine 1 as well as also with the base carrier 5 of the drill rig 3. The transfer device 4 includes a gripping unit 14 which will be described in greater detail with reference to FIGS. 3 and 4. The gripping unit 14 can be moved in vertical and horizontal directions in transverse relationship to the longitudinal axis of the base carrier 5 via rack-and-pinion drives of the transfer device 4. Two vertically aligned toothed racks 15 and two horizontally aligned toothed racks 16 are hereby provided for engagement of driving pinions of hydraulic motors, as shown in particular in FIG. 3. Depicted there is a forward first hydraulic motor 17 which acts via a gear mechanism on a first driveshaft 18 having ends provided with two driving toothed wheels 35 which mesh with the horizontally aligned toothed racks 16. A second hydraulic motor 19 drives a second driveshaft 20 having driving toothed wheels 36 in mesh with the vertical toothed racks 15. A controlled drive of both hydraulic motors 17, 19 enables a shift of the gripping unit 14 in vertical direction as well as along the horizontal toothed racks 16 in horizontal direction.

A linear drive is further integrated in the gripping unit 14 for movement of a gripper 21 of the gripping unit 14 in relation to the rod magazine 1 and to the base carrier 5 of the drill rig 3 in the direction of the longitudinal axis of a rod section 2 secured in the gripper 21. The linear drive based on a hydraulic cylinder is integrated in the gripper 21 of the gripping unit 14, as can be seen in particular in FIG. 4. The gripper 21 includes a support tube 22 having ends, each of which being provided with a gripping device. The support tube 22 is movable in the direction of the longitudinal axis in a guide tube 23 which is connected with a carrier 24 of the gripping unit 14. Situated in the carrier 24 are i.a. the driveshafts 18, 20 and the hydraulic motors 17, 19 of the rack-and-pinion drives as well as two guide bushings 25 for the vertical toothed racks 15 and guide rollers 26 for the horizontal toothed racks 16.

The hydraulic cylinder is placed within the support tube 22 and has a cylinder 27, which is connected via a cross pin 28 with the guide tube 23, and a piston 29, which has one end connected to the support tube 22. As the hydraulic cylinder moves in, the one end of the support tube 22 on which the piston 29 of the hydraulic cylinder is fixed is caused to move in the direction of the cylinder 27 and thus towards the guide tube 23. The cross pin 28 as well as two hydraulic ports 30 of the hydraulic cylinder are hereby guided in two guide grooves of the support tube 22. As the cylinder 27 moves out, a movement in opposite direction is effected.

Each of the gripping devices of the gripper 21 has two gripping elements 31 which can be rotated in a rocker-like manner about a pivot axis 32. The gripping elements 31 of each gripping device are acted upon by a prestressed spring (not shown) to seek the opened position illustrated in FIGS. 3 and 4. Closing of the gripping elements 31 is effected by pushing a wedge 34 by means of a small hydraulic cylinder 33 from atop into the intermediate space formed by both gripping elements 31 so that the upper ends of both gripping elements 31 are deflected to the outside and the opposing, i.e. lower, ends of the gripping elements 31 are moved towards one another, wherein a rod section 2 can be embraced.

Figure 2:
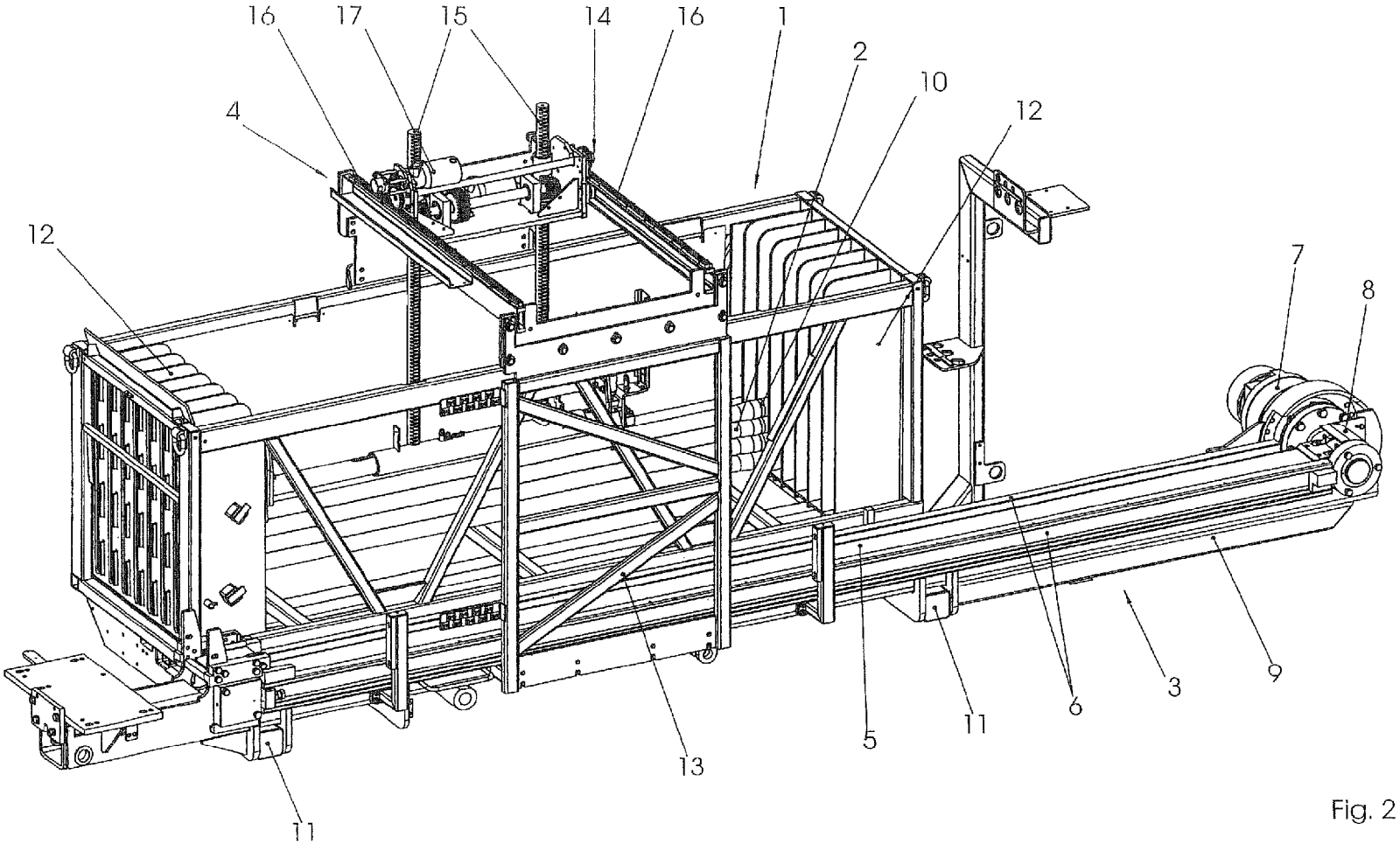
FIG. 2 is an isometric illustration of the drilling apparatus of FIG. 1 in a second operative position.

FIG. 2 illustrates the manner as to how the transfer device 4 grabs the uppermost of several rod sections 2 stored in a compartment of the rod magazine 1. The gripping unit 14 of the transfer device 4 has been moved for that purpose into the interior of the rod magazine 1. After grabbing the rod section 2 with the gripping elements 31, the gripping unit 14 is moved again upwards via the vertical rack-and-pinion drive until the gripping unit 14 including the attached rod section 2 is positioned above the rod magazine 1. Thereafter, the gripping unit 14 is moved across with the rod section 2 by means of the horizontally aligned rack-and-pinion drive until being positioned above the base carrier 5 of the drill rig 3. Thereafter, the gripping unit 14 is lowered with the rod section 2 far enough until the rod section 2 is positioned with its longitudinal axis in coaxial relationship to the drilling rod axis of the drill rig 3. By activating the linear drive integrated in the gripping unit 14, the threaded pin provided on the front side of the rod section 2 can be pushed into the respective threaded bushing of the last rod section of the drilling rod. Thereafter, the rear of the rotary drive of the drive carriage is connected with the rod section 2 to be attached, and the gripping elements 31 are released from the rod section 2 that is fixed in place thereby. By rotating the rotary drive including the attached rod section 2 while securing the already bored drill string by means of the clamping unit of the drill rig at the same time, the attached rod section 2 is threadably engaged with the drill rod. Thereafter, drilling operation can continue and the drilling rod extended by the new rod section can be advanced into the ground until the drive carriage has reached the lower end of the base carrier 5 of the drill rig 3. The rear end of the drilling rod is then clamped again and the rotary drive is released from the drilling rod through rotation in opposite direction. Thereafter, the rotary drive can again be moved to the rear end of the base carrier 5 of the drill rig 3 and the afore-described operating steps are repeated again to withdraw a further rod section 2 from the rod magazine 1 and to connect it with the drilling rod.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A drilling apparatus, comprising:

a drill rig which defines a drilling rod axis;

a rod magazine storing a plurality of rod sections; and a transfer device comprising first and second members movable in relation to one another in a direction of the drilling rod axis, said transfer device being constructed for transfer of a rod section from the rod magazine and for transfer of the rod section in the drilling rod axis of the drill rig, wherein the transfer device includes a gripping unit, said gripping unit including the first and second members, and a hydraulic drive to move the first and second members in the direction of the drilling rod axis, wherein the first member is configured as a guide and the second member is configured as a tube and is movable in the first member in the longitudinal direction, and wherein the hydraulic drive is arranged within the tube and includes a piston and a cylinder, with one member selected from the group consisting of the piston and the cylinder of the hydraulic drive being connected with the guide and with another member of the group being connected with the tube, wherein the gripping unit of the transfer device includes two gripping devices provided on the tube in spaced-apart relationship to one another for gripping a rod section in the rod magazine, wherein each of the gripping devices has gripping elements which are swingable about a pivot axis and acted upon by a wedge to move the gripping elements in a direction of their closed position, wherein the transfer device includes a spring to bias the gripping elements as to seek their open position.

2. The drilling apparatus of claim 1, wherein the first and second members are movable in relation to one another by means of a fluid cylinder.

3. The drilling apparatus of claim 1, wherein the hydraulic drive includes a fluid cylinder integrated in the gripping unit.

4. The drilling apparatus of claim 1, wherein the gripping devices are arranged on opposite ends of the tube.

5. The drilling apparatus as defined in claim 1, wherein the transfer device includes further drives to move the gripping unit in a direction of two further axes in relation to the rod magazine.

6. The drilling apparatus of claim 5, wherein the three axes extend in perpendicular relationship to one another.

7. The drilling apparatus of claim 5, wherein the drives are rack-and-pinion drives for movement along the two further axes.

8. A drilling apparatus, comprising:

a drill rig which defines a drilling rod axis;

a rod magazine storing a plurality of rod sections; and a transfer device comprising first and second members movable in relation to one another in a direction of the drilling rod axis, said transfer device being constructed for transfer of a rod section from the rod magazine and for transfer of the rod section in the drilling rod axis of the drill rig, wherein the transfer device includes a gripping unit, said gripping unit including the first and second members, and a hydraulic drive to move the first and second members in the direction of the drilling rod axis, wherein the transfer device includes further drives to move the gripping unit in a direction of two further axes in relation to the rod magazine, wherein the drives are rack-and-pinion drives for movement along the two further axes, and wherein the rack-and-pinion drives include a fluid motor.

* * * * *